US007104057B2

(12) United States Patent
Jung

(10) Patent No.: US 7,104,057 B2
(45) Date of Patent: Sep. 12, 2006

(54) CONCRETE-MORTAR TRANSFER SYSTEM OF CONCRETE PUMP CAR

(75) Inventor: Chul Jong Jung, Cheongju (KR)

(73) Assignee: DNS Co., Ltd., Cheongju (KR)

( * ) Notice: Subject to any disclaimer, the term of this patent is extended or adjusted under 35 U.S.C. 154(b) by 121 days.

(21) Appl. No.: 10/898,879

(22) Filed: Jul. 26, 2004

(65) Prior Publication Data

US 2005/0232069 A1 Oct. 20, 2005

(30) Foreign Application Priority Data

Apr. 19, 2004 (KR) ..... 10-2004-0026714

(51) Int. Cl.
*F15B 7/02* (2006.01)

(52) U.S. Cl. ..... 60/538; 60/422; 91/529

(58) Field of Classification Search ..... 60/422, 60/452, 538; 91/189 R, 518, 529
See application file for complete search history.

(56) References Cited

U.S. PATENT DOCUMENTS 5,316,453 A * 5/1994 Schwing ..... 417/516
5,520,521 A * 5/1996 Benckert et al. ..... 417/280
5,536,151 A * 7/1996 von Eckardstein ..... 417/429
5,640,850 A * 6/1997 Benckert et al. ..... 60/422
6,267,571 B1 * 7/2001 Anderson et al. ..... 91/189 R
6,299,416 B1 * 10/2001 Kwag ..... 417/403

* cited by examiner

*Primary Examiner*—Edward K. Look
*Assistant Examiner*—Michael Leslie
(74) *Attorney, Agent, or Firm*—Darby & Darby

(57) ABSTRACT

A concrete transfer system for a concrete pump car has a pair of concrete input tubes mounted in a hopper, first and second drive cylinders operating with the concrete input tubes for inputting and outputting the concrete by pressure pistons each having a driving rod, an oil pressure pump for supplying oil to the first and second drive cylinders, and a movement sensor for each of the driving rods. A control unit receives a sensing signal from each sensor and there are a plurality of logic valves operated by the control unit that are selectively opened and closed to supply oil to opposite sides of the driving rod of each of the cylinders. A high-low pressure selection valve operates to perform the concrete transfer at either high or low oil pressure.

8 Claims, 6 Drawing Sheets

CONCRETE-MORTAR TRANSFER SYSTEM OF CONCRETE PUMP CAR

BACKGROUND OF THE INVENTION

1. Field of the Invention

The present invention relates to a concrete-mortar transfer system of a concrete pump car in which the concrete transfer system is mounted to the concrete pump car for transferring the mortar concrete to a placing position at a construction job-site and when increasing/decreasing the transfer distance of the concrete, a work for separating or changing the concrete pump car is not required, thereby selectively capable of transferring the concrete with a high or a low pressure by a simple operation.

2. Description of the Background Art

Generally, a pump car is an equipment for transferring the fluent mortar concrete to the placing position of the concrete and includes a transfer system for transferring the mortar concrete(hereinafter, referred as concrete) with pressure. The transfer system sucks the concrete inputted to a hopper from a ready-mixed concrete car and thereafter transfers it to the placing position by an operation of a piston through a transfer tube mounted up to the placing position. Also, a boom apparatus for leading the transfer tube for transferring the concrete up to a high position may be selectively mounted to the pump car.

Also, FIG. 1 is an outline plane view for explaining a concrete transfer system of a concrete pump car in accordance with a conventional art and FIG. 2 is an oil pressure circuit diagram for simply showing a concrete transfer system of a concrete pump car in accordance with a conventional art. As shown in FIGS. 1 and 2, the concrete transfer system comprises a pair of concrete input tubes 20 and 30 mounted in union to communication holes punched to the inside surface of the hopper 10 on which an agitator 12 worked by the power of an engine is mounted, drive cylinders 40 and 50 mounted on the same lines of the concrete input tubes 20 and 30 for sucking and transferring the concrete by forward and backward movements of pressure pistons 44 and 54 mounted to rod ends 42 and 52, an oil pressure apparatus including an oil pressure pump, various control valves and an oil pressure hose for driving the drive cylinders and simultaneously controlling their driving operations.

A swing valve 14 is mounted between communication holes of the concrete input tubes 20 and 30 and a discharge hole of a transfer tube 16*a* and performs a swing operation for communicating alternately it to both communication holes, and when advancing the rod, the concrete discharged from the concrete input tubes 20 and 30 can be transferred to the transfer tube 16.

On the other hand, the concrete transfer system in accordance with the conventional art will be described as follows. As shown in FIG. 2, the drive cylinder comprises a first drive cylinder 40 and a second drive cylinder 50, inside pistons b of the first and second drive cylinders 40 and 50 are connected with each other by a connection oil pressure line 66, a rod side a of the first drive cylinder 40 and a side of an oil pressure pump 60 are connected with each other by a first supply line 62, and a rod side a of the second drive cylinder 50 and the other side of the oil pressure pump 60 are connected with each other by a second supply line 64.

The oil pressure pump 60 comprises an oil path change drive unit 70 for capable of changing the flow direction of the fluid pumped and transferred into a side or the other side. The oil path change drive unit 70 can be constructed variously by an oil pressure type or an electric type and generally it is constructed by the oil pressure type. The oil pressure change drive unit is well-known in the art, its detailed explanation and the drawing will be omitted.

The oil path change drive unit 70 is operated by the control signal of a control unit 80, thereby transferring the fluid to the rod side a of a first drive cylinder 40 or a second drive cylinder 50. The control signal applied to the oil path change drive unit 70 by the control unit 80 is produced as follows; as shown in FIG. 1, when a rod sensing sensor 90 mounted on a connection box(a water box) 100, which is mounted between the concrete input tubes 20 and 30 and the body unit of the drive cylinder, senses the movement of the rod, the control unit 80 receives the sensing signal from the rod sensing sensor 90 and produces the control signal.

More specifically, two rod sensing sensor 90 are installed to an upper portion of a rod movement path of the connection box 100 for sensing the movement of the rods 42 and 52 of the first drive cylinder 40 and the second drive cylinder 50, sense a sensing block 51 interlocked when moving the rods and applies a sensing signal to the control unit 80. For example, as shown in FIGS. 1 and 2, when oil pressure is supplied to a rod side a of the first drive cylinder 40, the rod is moved backwardly and the concrete is sucked into the inside of the concrete input tube 20. Also, when a piston of the first drive cylinder 40 is moved backwardly, the fluid at the front of the piston is inputted to a piston side b of the second drive cylinder 50 through a connection oil pressure line 66. Accordingly, the rod of the second drive cylinder 50 is advanced and pushed ahead the concrete filled on the concrete input tube 30 in the front of the rod. At this time, a swing valve 14 is communicated with the communication hole of the concrete input tube 30 by a predetermined operation, thereby transferring the concrete to the transfer tube 16.

In the process as above, when the rod of the first drive cylinder 40 is moved backwardly completely, the sensing block 41 installed to an end side of the rod is sensed by the rod sensing sensor 90 and the state that a backward movement of the first drive cylinder 40 is completed is applied to the control unit 80. Accordingly, the control unit 80 applies a control signal to an oil path change drive unit 70, thereby supplying the fluid pumped by the oil pressure pump 60 to the rod side a of the second drive cylinder 50 through a second supply line 64, and then the rod of the second drive cylinder 50 is moved backwardly, so that the concrete is sucked to the concrete input tube 30. The fluid within the inside of the piston is inputted to the inside of the first drive cylinder 40 through the connection oil pressure line 66 and then the piston is pushed out, so that the rod of the first drive cylinder 40 is advanced and pushed ahead the concrete filled on the concrete input tube 20 in the front of the rod, thereby transferring the concrete to the transfer tube 16.

Also, in the above process, when the rod of the second drive cylinder 50 is completely moved backwardly, the sensing block 51 installed at an end side of the rod is again sensed by the rod sensing sensor 90 and the state that a backward movement of the first drive cylinder 50 is completed is applied to the control unit 80, the control unit 80 applies a control signal to an oil path change drive unit 70, thereby repeating the above operation.

On the other hand, the concrete transfer system of the concrete pump car sucks the concrete of a hopper of a ready-mixed concrete car and thereafter transfers the concrete to a placing position by an operation of the piston. When the transfer distance is determined, a boom apparatus having a predetermined length of a transfer tube is constructed by the pump car, however, since the height of the building is variable, there is needed a concrete transfer system having a proper transfer distance.

However, in the conventional concrete transfer system as shown in FIG. 2, oil with a constant pressure is always supplied to a rod side a of the drive cylinder from the oil pressure pump 60, so that the force for advancing the piston by the fluid inputted to the inside of the cylinder is comparatively weaker (than the structure that the fluid is inputted to the piston side of the drive cylinder), so that it is only possible to transfer the concrete with a short distance. The reason, as well known in the art, is that the force applied to the rod side for sucking or discharging the concrete is proportional to the unit area where the oil pressure is worked. Accordingly, because the unit area of the piston at the rode side is smaller than the inside area of the cylinder piston, in the conventional concrete transfer system, because the fluid(oil pressure oil) is only always supplied to the rod side, the force applied to the rod is weak, accordingly, the force of the pressure pistons 44 and 54 for performing a sucking and discharging operation within the concrete input tube become weak, so that there is a disadvantage that it can be only used for transferring a short distance.

Also, as shown in FIG. 2, in the conventional concrete transfer system of the concrete pump car, for increasing the transfer distance of the concrete, when the position for supplying the fluid from the oil pressure pump 60 to the inside of the cylinder is changed to the piston side b of the cylinder, respectively, the transfer distance of the concrete can be increased. However, at this time, there are several problems that since each oil horse must be separated and assembled by exchanging with the combining positions, so that the working is very difficult and it is required much time in the exchanging work. Also, since various devices are mounted to the concrete transfer system, it is difficult to separate and assemble the devices in the narrow places.

In addition, since the length of the drive cylinder is very long and all oil pressure horses also must be formed very long for changing the connection positions of the oil pressure horses, the concrete transfer system become very complex and it is difficult to mount the system to the pump car. Especially, when the oil pressure horses are separated for changing the connection positions, the pressure oil is discharged, so that when the oil must not be injected again after assembling, the device dose not work in proper. Also, there may be occurred a contamination of the pump car or a serious environment contamination due to the oil leaked at the circumference.

SUMMARY OF THE INVENTION

Accordingly, it is an object to provide a concrete transfer system of a concrete pump car in which when increasing or decreasing the transfer distance, it is not required to perform a separation or a change work and the concrete can be selectively transferred with a high or a low pressure by a simple operation, thereby reducing the cost of the various building constructions, the construction period and simultaneously maximizing the customer's satisfaction.

In order to achieve the above-described object of the invention, there is provided a concrete transfer system of a concrete pump car which comprises a pair of concrete input tubes mounted in union to a pair of communication holes punched to the inside surface of a hopper, first and second drive cylinders mounted on the same lines of the concrete input tubes for sucking and transferring the concrete by forward and backward movements of pressure pistons mounted to rod ends, an oil pressure pump for supplying the fluid to the first and second drive cylinders, a rod sensing sensor for sensing the movement of the rods of the first and second drive cylinders, a control unit for performing a predetermined control operation by receiving the sensing signal of the rod sensing sensor, an oil path change drive unit for supplying selectively the fluid with the first and second drive cylinders according to the control signal of the control unit, the concrete transfer system of the concrete pump car comprising: a first logic valve in which a first oil pressure line connected to a side of the oil pressure pump is connected to an input side of a main spool, the output side of the main spool is a rod side of the second drive cylinder by the medium of a third oil pressure line; a second logic valve in which an input side of a main spool is connected to the first oil pressure line, thereby connecting the second logic valve in parallel to the first logic valve, the output side of the main spool is a piston side of the first drive cylinder by the medium of a fourth oil pressure line; a third logic valve in which an input side of a main spool is connected to the second oil pressure line connected to the other side of the oil pressure pump, the output side of the main spool is a rod side of the first drive cylinder by the medium of a fifth oil pressure line; a fourth logic valve in which an input side of a main spool is connected to the second oil pressure line, thereby connecting the fourth logic valve in parallel to the third logic valve, the output side of the main spool is a piston side of the second drive cylinder by the medium of a sixth oil pressure line; a reverse current preventive device in which an input port is installed on the first and second oil pressure lines for preventing the reverse current for generating to the oil pressure pump and output ports are connected with each other; a high/low pressure selection valve in which a supply port is connected to an output port of the reverse current preventive device, a first work port combined with an oil pressure line, which is selectively communicated to the supply port and connected to control spool sides of the second and fourth logic valves, a second work port combined with an oil pressure line, which is selectively communicated to the supply port and connected to control spool sides of the first and third logic valves, and a discharge port selectively communicated to the first and second work ports; a fifth logic valve in which a control spool side is connected to a first work port of the high/low pressure selection valve, a discharge side of the main spool is connected to the third oil pressure line and the input side of the main spool is connected to the fifth oil pressure line; and a sixth logic valve in which a control spool side is connected to a second work port of the high/low pressure selection valve, a discharge side of the main spool is connected to the fourth oil pressure line and the input side of the main spool is connected to the sixth oil pressure line.

Preferably, a check valve is installed on the oil pressure line between the high/low pressure selection valve and a reverse current preventive device for preventing a reverse current from generating toward the reverse current preventive device.

More preferably, the first to sixth logic valves, the reverse current preventive device and the high/low pressure selection valve are connected and arranged as one oil pressure unit.

More preferably, the high/low pressure selection valve is a 4/2 way valve which has two change positions changed by an operating force of an operation lever, and two work ports, a supply port and a discharge port formed at the two change positions.

More preferably, the volume of the oil pressure pumps can be increased according to the transfer distance or the transfer capacity of the concrete and the first to sixth pressure lines may be constructed in plural according to the number or the oil pressure of the oil pressure pumps.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

A concrete transfer system of a concrete pump car in accordance with preferred embodiments of the present invention will now be described in detail with reference to the accompanying drawings.

Figure 1:
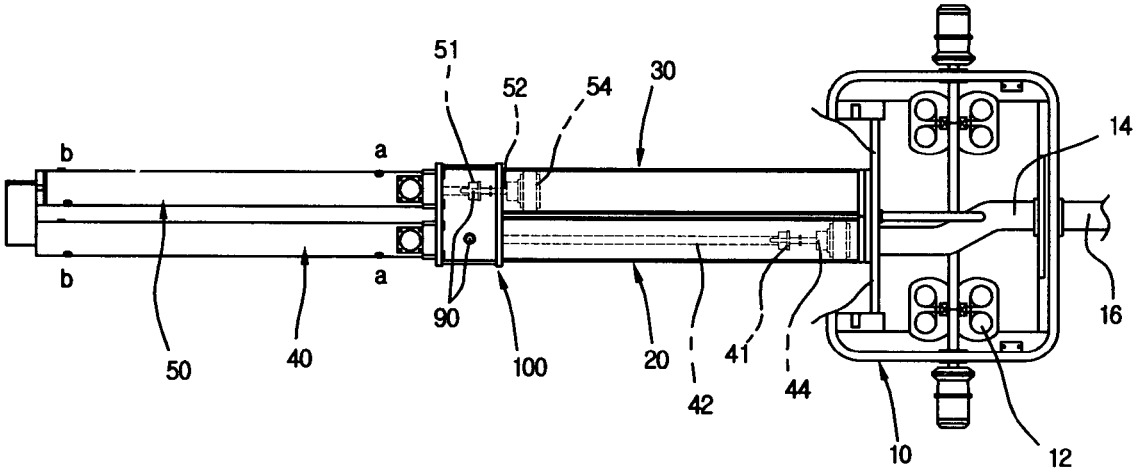
FIG 1 Prior Art
FIG. 1 is an outline plane view illustrating a concrete transfer system of a general concrete pump car.
Figure 2:
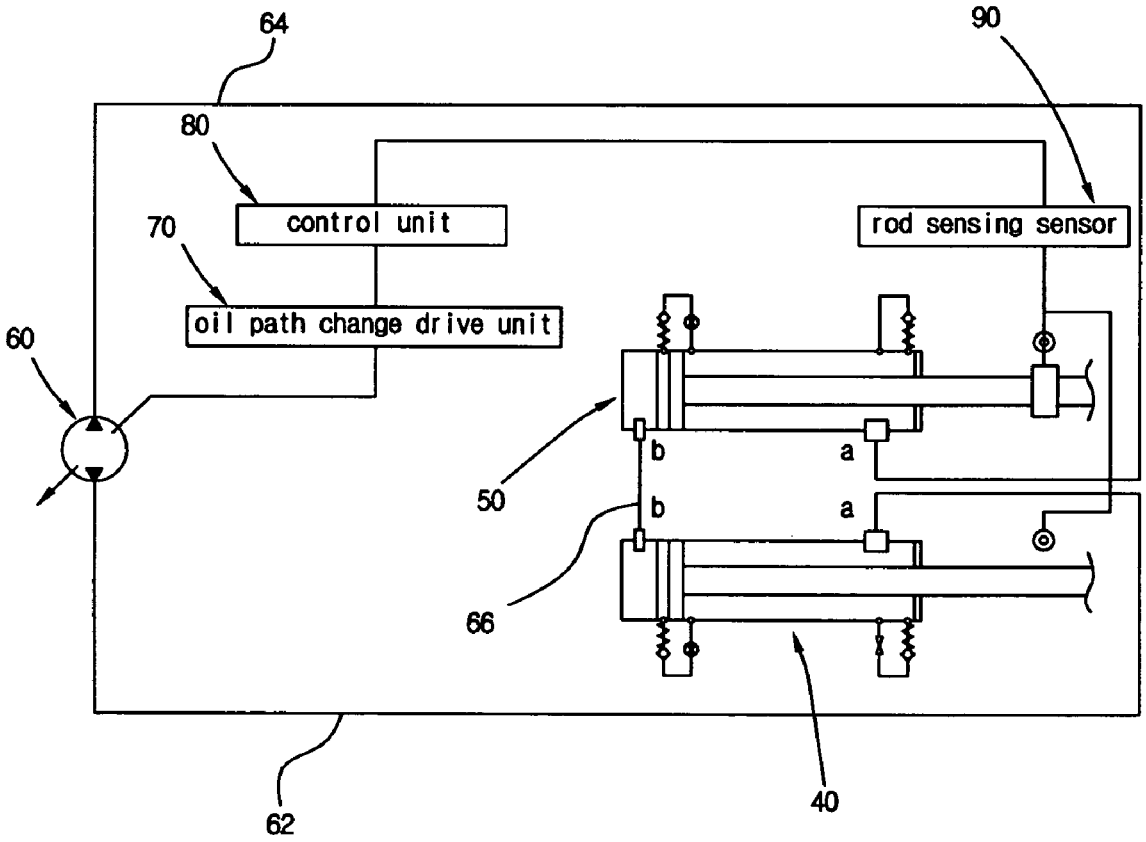
FIG 2 Prior Art
FIG. 2 is an outline oil pressure circuit illustrating a concrete transfer system of a concrete pump car in accordance with the conventional art.
Figure 3A:
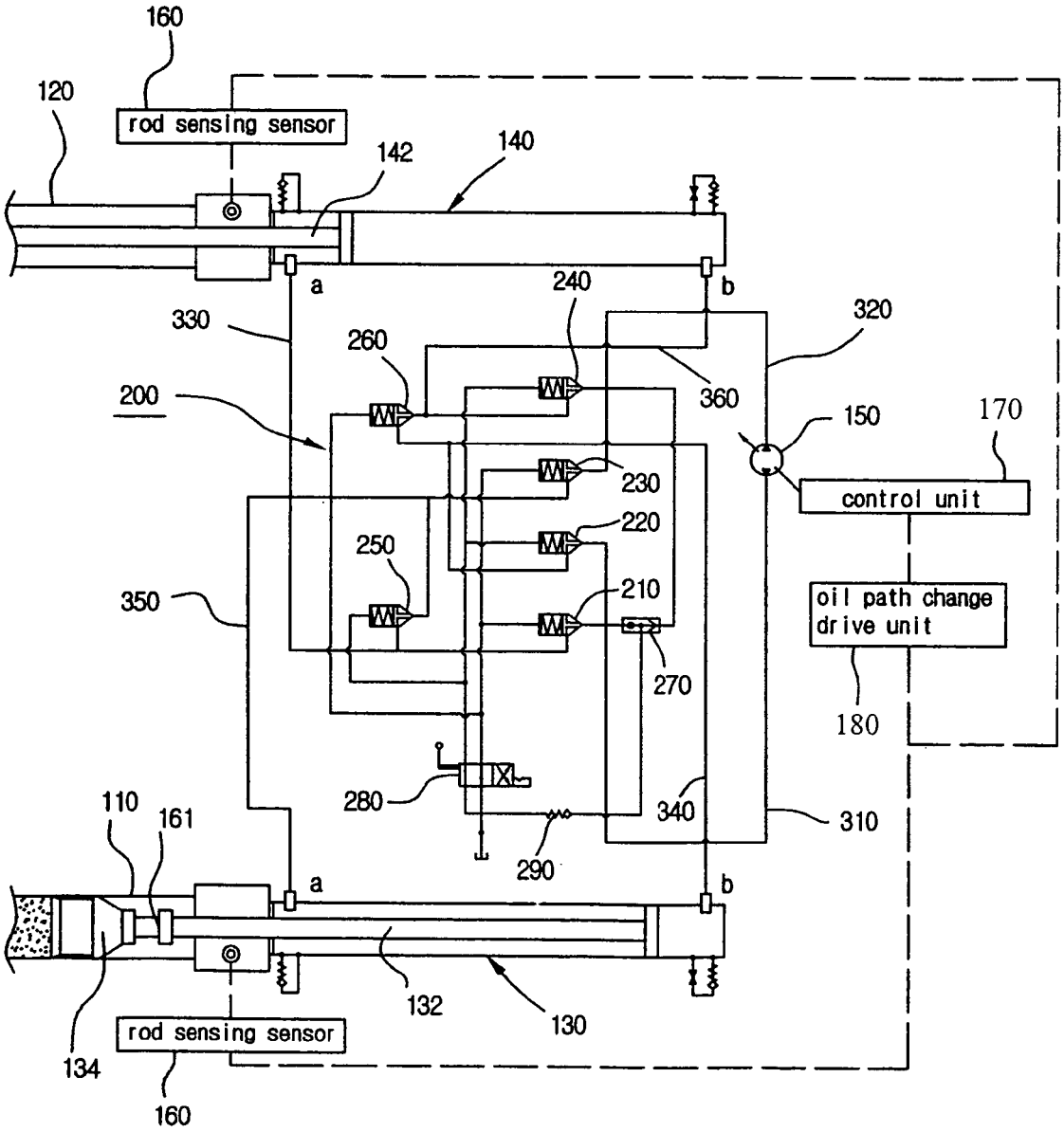
FIG. 3*a* is an outline oil pressure circuit illustrating a concrete transfer system of a concrete pump car in accordance with an embodiment of the present invention.
Figure 3B:
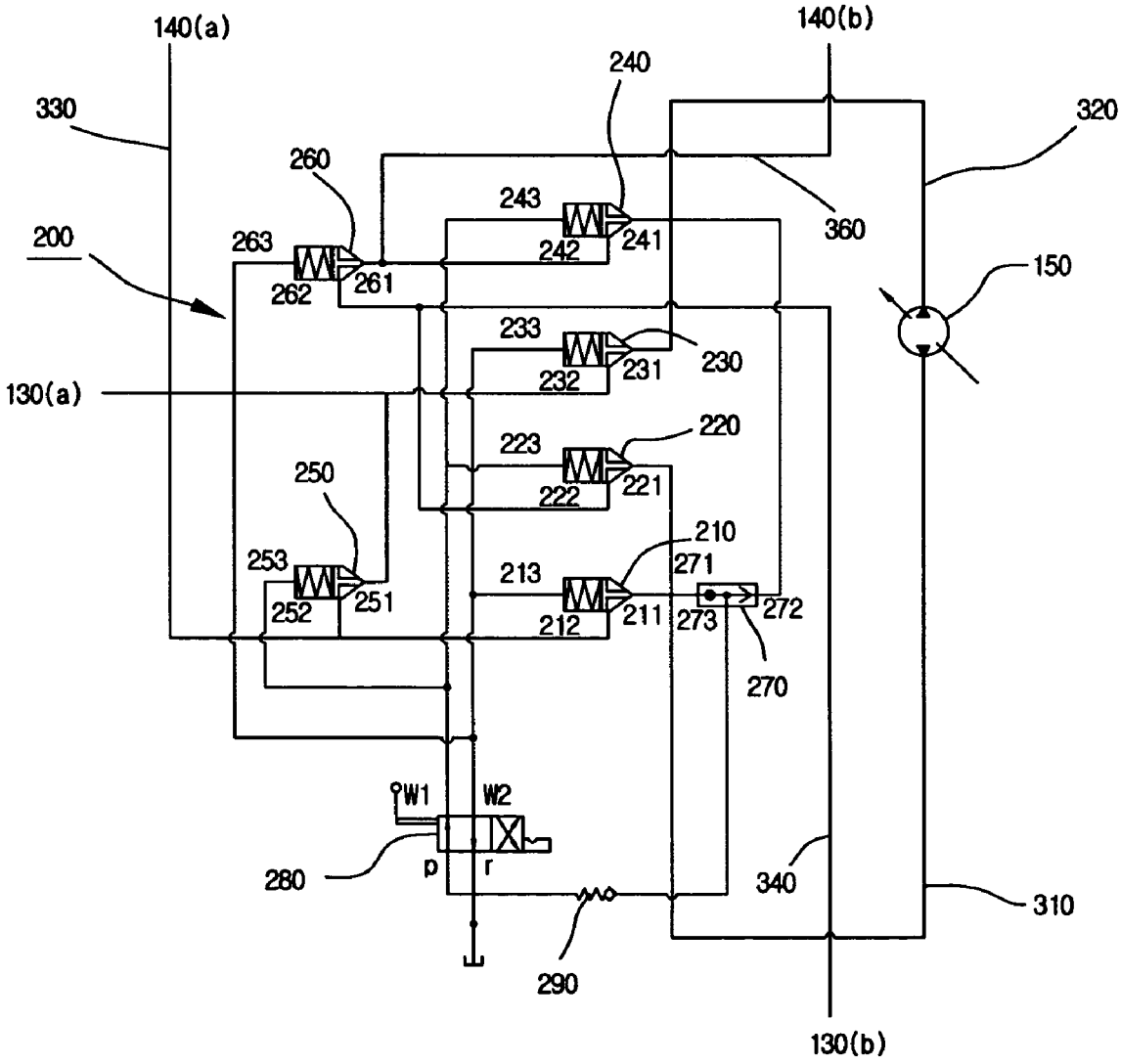
FIG. 3*b* is a partially enlarged view of FIG. 3*a;*
Figure 4:
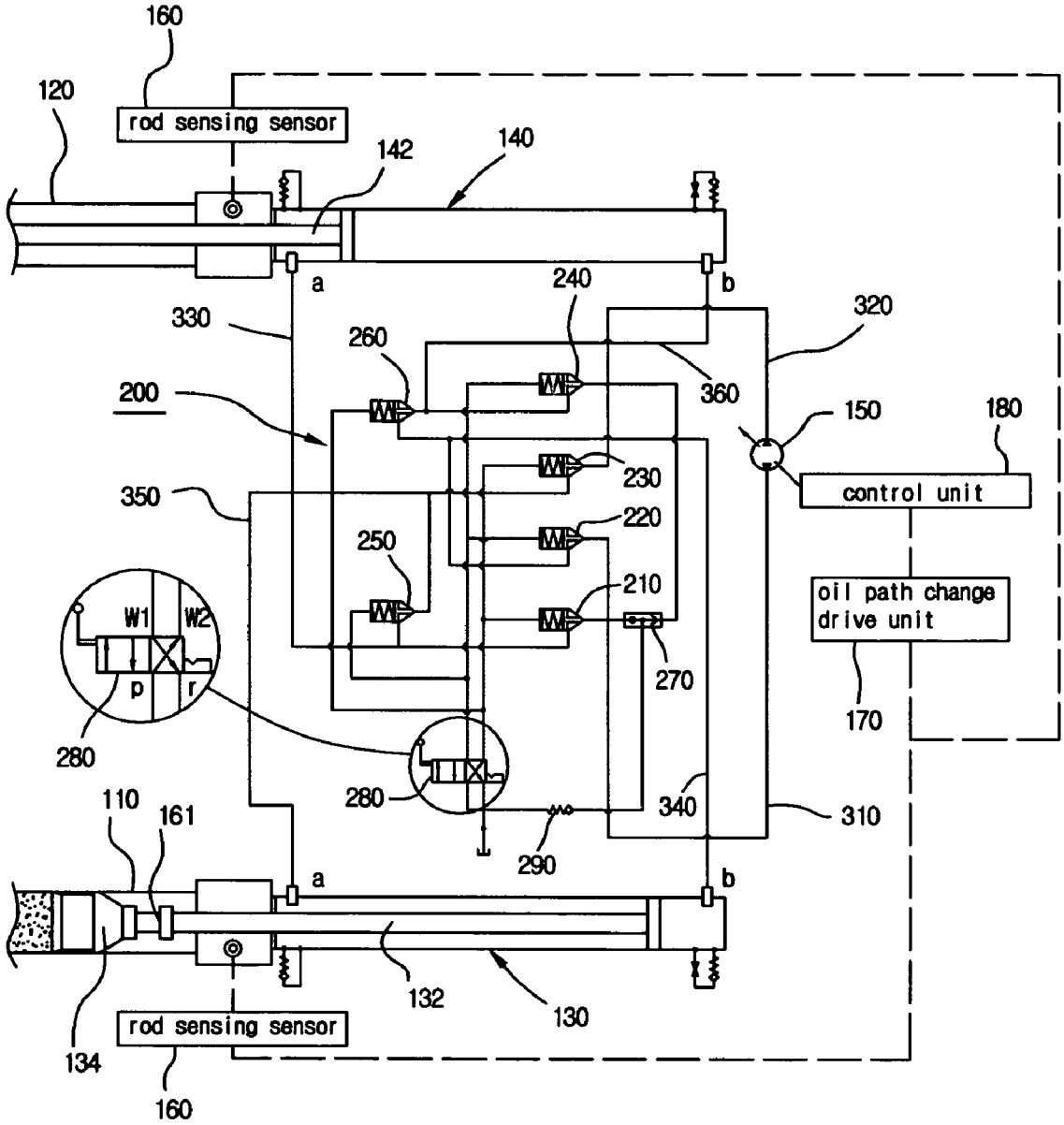
FIG. 4 is an outline oil pressure circuit for explaining an operation of a concrete transfer system of a concrete pump car in accordance with an embodiment of the present invention.

FIG. 3*a* is an outline oil pressure circuit diagram illustrating a concrete transfer system of a concrete pump car in accordance with an embodiment of the present invention, FIG. 3*b* is a partially enlarged view of FIG. 3*a*, and FIG. 4 is an oil pressure circuit diagram illustrating a concrete transfer system of a concrete pump car in accordance with an embodiment of the present invention.

As shown in FIGS. 3 and 4, a concrete transfer system of a concrete pump car comprises a pair of concrete input tubes 110 and 120 mounted in union to a pair of communication holes punched to the inside surface of a hopper, first and second drive cylinders 130 and 140 mounted on the same lines of the concrete input tubes 110 and 120 for sucking and transferring the concrete by forward and backward movements of pressure pistons mounted to rod ends 132 and 142, an oil pressure pump 150 for supplying the fluid to the first and second drive cylinders 130 and 140, a rod sensing sensor 160 for sensing the movement of the rods of the first and second drive cylinders 130 and 140, a control unit 170 for performing a predetermined control operation by receiving the sensing signal of the rod sensing sensor, an oil path change drive unit 180 for supplying selectively the fluid with the first and second drive cylinders 130 and 140 according to the control signal of the control unit 170, and an oil pressure unit 200 comprising first and sixth logic valves 210,220,230,240,250 and 260, a reverse current preventive device 270 and a high/low pressure selection valve 280 for supplying selectively the fluid, which is supplied to the inside of the first and second drive cylinders 130 and 140, to the rod side a or the piston side b selectively.

In the first logic valve 210, a first oil pressure line 310 connected to a side of an oil pressure pump 150 is connected to an input side 211 of a main spool, the output side 212 of the main spool is a rod side a of the second drive cylinder 140 by the medium of a third oil pressure line 330 and the control spool side 213 is connected to a second work port w2 of the high/low pressure selection valve, which will be described hereinafter.

In the second logic valve 220, an input side 212 of a main spool is connected to the first oil pressure line 310, thereby connecting the second logic valve 20 in parallel to the first logic valve 210, the output side 222 of the main spool is a piston side b of the first drive cylinder 130 by the medium of a fourth oil pressure line 340 and the control spool side 223 is connected to a first work port w1 of the high/low pressure selection valve.

In the third logic valve 230, an input side 231 of a main spool is connected to the second oil pressure line 320 connected to the other side of the oil pressure pump 150, the output side 232 of the main spool is a rod side a of the first drive cylinder 130 by the medium of a fifth oil pressure line 350 and the control spool side 233 is connected to a second work port w2 of the high/low pressure selection valve 280.

In the fourth logic valve 240, an input side 241 of a main spool is connected to the second oil pressure line 320, thereby connecting the fourth logic valve 240 in parallel to the third logic valve 230, the output side 242 of the main spool is a piston side b of the second drive cylinder 140 by the medium of a sixth oil pressure line 360 and the control spool side 243 is connected to a first work port w1 of the high/low pressure selection valve.

In the reverse current preventive device 270, an input port is installed on the first and second oil pressure lines for preventing the reverse current for generating to the oil pressure pump and output ports are connected with each other. For example, a check valve is installed on the first oil pressure line 310, a separate check valve is installed on the second oil pressure line 320 and then the output ports are connected with each other and thereafter the output port and a supply port of the high/low pressure selection valve are connected. According to the appended drawing, the reverse current preventive device constructed by assembling two check valves as a shuttle valve shape will be described in more detail. According this, a first input port 271 is connected on the first oil pressure line 310, a second input port 272 is connected on the second oil pressure line 320 and an output port 273 is connected to a supply port p of the high/low pressure selection valve 280.

In the high/low pressure selection valve 280, a supply port p is connected to an output port 273 of the reverse current preventive device 270, a first work port w1 combined with an oil pressure line, which is selectively communicated to the supply port p and connected to control spool sides 223 and 243 of the second and fourth logic valves 220 and 240, a second work port w2 combined with an oil pressure line, which is selectively communicated to the supply port p and connected to control spool sides 213 and 233 of the first and third logic valves 210 and 230, and a discharge port r selectively communicated to the first and second work ports w1 and w2.

Preferably, the high/low pressure selection valve 280 is a 4/2 way valve which has two change positions changed by an operating force of an operation lever, and two work ports, a supply port and a discharge port formed at the two change positions.

In the fifth logic valve 250, a control spool side 253 is connected to a first work port w1 of the high/low pressure selection valve 280, a discharge side 252 of the main spool is connected to the third oil pressure line 330 and the input side 251 of the main spool is connected to the fifth oil pressure line 350.

In the sixth logic valve 260, a control spool side 263 is connected to a second work port w2 of the high/low pressure selection valve 280, a discharge side 262 of the main spool is connected to the fourth oil pressure line 340 and the input side 261 of the main spool is connected to the sixth oil pressure line 360.

In the oil pressure unit 200, a check valve 290 is installed on the oil pressure line between the high/low pressure selection valve 280 and a reverse current preventive device 270 for preventing a reverse current from generating toward the reverse current preventive device.

Also, the first to sixth logic valves 210,220,230,240,250 and 260, the reverse current preventive device 270 and the high/low pressure selection valve 280 are connected and arranged as one oil pressure unit, thereby reducing the entire volume and enhancing the performance of assembling and maintenance.

In addition, as shown in FIG. 3*a*, on a circumference surface of a rod side a of a body of the first drive cylinder 130 and the second drive cylinder 140, an oil pressure line is formed with a distance which is longer than the thickness of a piston and a check valve is mounted, so that at the state that the piston is moved backwardly toward the rod side completely, the fluid(working oil) of the inside of cylinder is discharged in a moment toward the rod side and circulated. On the contrary, on a circumference surface of the piston side b of the cylinder body, a throttling valve and a check valve are mounted, so that at the state that the piston is advanced completely, the fluid of the rod inside is discharged forwardly and circulated.

Figure 5:
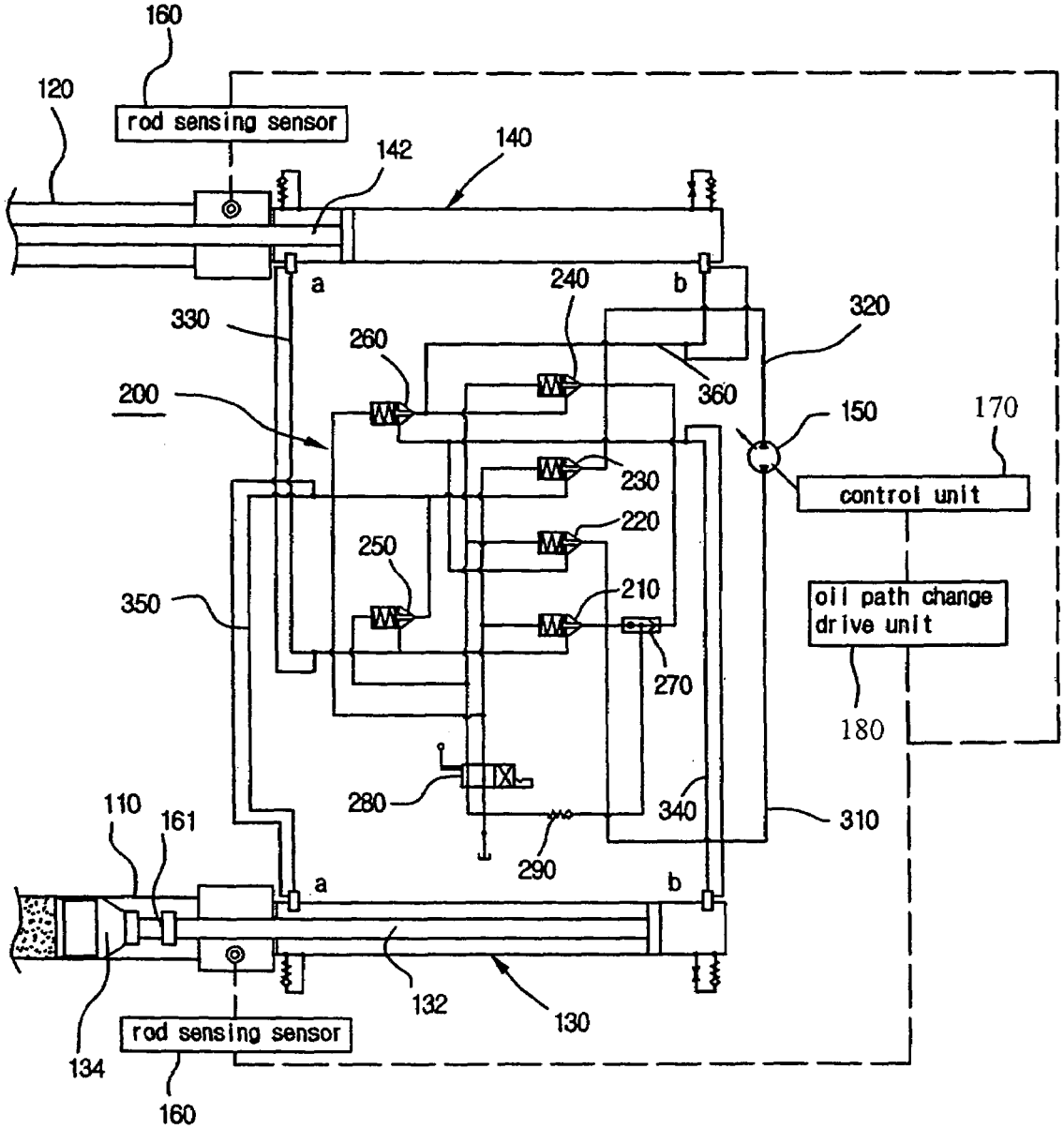
FIG. 5 is an oil pressure circuit illustrating a concrete transfer system of a concrete pump car in accordance with another embodiment of the present invention.

As appended, FIG. 5 is an oil pressure circuit diagram illustrating another embodiment of a concrete transfer system of a concrete pump car in accordance with the present invention. As shown in FIG. 5, the third to sixth oil pressure lines 330,340,350 and 360 are constructed by two lines because of following reasons: the volume of the oil pressure pump 150 can be increased according to the transfer distance or the transfer capacity of the concrete and stability of the oil pressure system is realized due to two lines. That is, the first to sixth pressure lines may be constructed in plural according to the number or the oil pressure of the oil pressure pumps.

An operation of the present invention will be described as follows.

Firstly, a process for supplying the concrete to a transfer tube at a low pressure(when a transfer distance is short comparatively) by using the concrete transfer system of the concrete pump car will be described. As shown in FIG. 3*a*, when the fluid from the oil pressure pump 150 is supplied and transferred to the first oil pressure line 310 at the state that the high/low pressure selection valve 280 is operated so that the supply port p of the high/low pressure selection valve 280 may be communicated with the first work port w1, an oil pressure is worked to control spool sides 223,243 and 253 of the second logic valve 220, the fourth logic valve 240 and the fifth logic valve 250, and to the input sides 211 and 221 of the main spool of the first and second logic valves 210 and 220. At this time, the second logic valve 220, the fourth logic valve 240 and the fourth logic valve 250 are closed(the control spool side in which its area affected by the oil pressure is relatively large is moved toward an input side of the main spool and therefore the oil path is blocked).

According this, the fluid supplied to the first oil pressure line 310 is transferred to a rod side a of the second drive cylinder 140 through the third oil pressure line 330 via input and discharge sides 211 and 212 of a main spool of the opened first logic valve 210, the piston is advanced and the rod is pulled, so that the mortar concrete is sucked to the inside of the concrete input tube 120 through a sucking operation by the pressurized piston. Then the fluid positioned at the front of the piston of the second drive cylinder 140 is discharged through the sixth oil pressure line 360 connected to the piston side b by a reverse operation and thereafter transferred to the piston side b of the first drive cylinder 130 via input and discharge sides 261 and 262 of the sixth logic valve 260, the piston is pushed and the rod is advanced, so that the mortar concrete inputted to the concrete input tube 110 is pushed out by the pressurized piston and discharged to the transfer tube through a swing valve.

Also, when the backward movement of the rod of the second drive cylinder 140 is completed, the sensing block 161 combined to the rod is sensed by the rod sensing sensor 160 and when the sensed signal is applied to the control unit 170, the control unit drives the oil path change drive unit 180 so that the flow direction of the fluid supplied to the first oil pressure line 310 can be changed to the second oil pressure line 320. At this time, if the high/low pressure selection valve 280 is operated so that the supply port p can be communicated with the first work port w1, the second logic valve 220, the fourth logic valve 240 and the fifth logic valve 250 are maintained as a closed state.

According this, the fluid supplied to the second oil pressure line 320 is transferred to a rod side a of the first drive cylinder 130 through the fifth oil pressure line 350 via input and discharge sides 231 and, 232 of a main spool of the opened third logic valve 230, the piston is advanced and the rod is pulled, so that the mortar concrete is sucked to the inside of the concrete input tube 110 through a sucking operation by the pressurized piston 134. Then the fluid positioned at the front of the piston of the first drive cylinder 130 is discharged through the fourth oil pressure line 340 connected to the piston side b by a reverse operation and thereafter transferred to the piston side b of the second drive cylinder 120, the piston is pushed and the rod is advanced, so that the mortar concrete inputted to the concrete input tube 120 is pushed out and discharged to the transfer tube through a swing valve. That is, if the high/low pressure selection valve 280 is operated as the state as shown in FIG. 3*a*, the above operations are repeated and the concrete is continuously transferred with a discharge pressure with a low pressure.

On the other hand, in the above state, when the mortar concrete is supplied to a high pressure, that is, when the concrete is transferred to the high-storied building, it is finished that only the high/low selection valve 280 is operated without various complex operations as shown in FIG. 4. In the state as above, the concrete transfer process with high pressure will be described as follows. The fluid from the oil pressure pump 150 is supplied and transferred to the first oil pressure line 310 at the state that the high/low pressure selection valve 280 is operated so that the supply port p may be communicated with the second work port w2, an oil pressure is worked to control spool sides 213,233 and 263 of the first logic valve 210, the third logic valve 230 and the sixth logic valve 260, and to the input sides 211 and 221 of the main spool of the first and second logic valves 210 and 220. At this time, the first logic valve 210, the third logic valve 230 and the sixth logic valve 260, in which a relatively high oil pressure is applied to their control spools, are closed.

According this, the fluid supplied to the first oil pressure line 310 is transferred to a piston side b of the first drive cylinder 130 through the fourth oil pressure line 340 via input and discharge sides 221 and 222 of a main spool of the opened second logic valve 220, the piston is advanced and the rod 132 is moved to a concrete input tube 110, so that the concrete inputted to the concrete input tube is discharged.

Then the piston of the first drive cylinder 130 is moved to a rod side a and the fluid inputted within the cylinder of the rod side is discharged through the fifth oil pressure line 350 connected to the rod side a by a reverse operation and thereafter transferred to the rod side a of the second drive cylinder 130 by the medium of input and discharge sides 251 and 252 of the fifth logic valve 250, the piston is pushed and the rod is reversed(pulled to the piston side b), so that the mortar concrete is sucked to the inside of the concrete input tube 110.

Also, when the backward movement of the rod of the second drive cylinder 140 is completed, the sensing block 161 combined to the rod is sensed by the rod sensing sensor 160 and when the sensed signal is applied to the control unit 170, the control unit drives the oil path change drive unit 180 so that the flow direction of the fluid supplied to the first oil pressure line 310 can be changed to the second oil pressure line 320. At this time, if the high/low pressure selection valve 280 is operated so that the supply port p can be communicated with the second work port w2, the first logic valve 210, the third logic valve 230 and the sixth logic valve 260 are maintained as the closed state. In the state as above, the fluid supplied to the second oil pressure line 320 is transferred to a piston side b of the second drive cylinder 140 through the sixth oil pressure line 360 via input and discharge sides 241 and 242 of a main spool of the opened fourth logic valve 240, the piston is advanced(moved to the rod side a) and the rod is pushed, so that the mortar concrete within the inside of the concrete input tube 120 is discharged by the pressurized piston combined to the rod end portion.

Then the fluid positioned at the front of the piston of the second drive cylinder 140 is inputted to a rod side a of the first drive cylinder 130 via the third oil pressure line 330 and the fourth logic valve 250 by a reverse operation, the piston is advanced and the rod is pulled to the piston side b, so that mortar concrete is sucked into within the concrete input tube 110. That is, if the high/low pressure selection valve 280 is operated as the state as shown in FIG. 4, the above operations are repeated and the concrete is continuously transferred with a discharge pressure with high pressure.

According to the present invention, there are several advantages that since the supply position of the oil supplied from the oil pressure pump can be selectively controlled toward a rod side or a piston side according to the transfer distance of mortar concrete, mortar concrete can be transferred with a short distance or a long distance as occasion demands.

Also, since concrete can be transferred with a short distance or a long distance as occasion demands, the construction cost in construction is reduced and simultaneously the customer's satisfaction can be maximized.

In addition, the transfer distance of concrete can be controlled on the spot by a simple operation, the construction is very simple and an environmental contamination does not occurred.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalences of such metes and bounds are therefore intended to be embraced by the appended claims.

What is claimed is:

1. A concrete transfer system of a concrete pump car which comprises;

a pair of concrete input tubes mounted to a pair of holes in the inside surface of a hopper, first and second drive cylinders mounted in communication with the concrete input tubes for sucking and transferring the concrete by forward and backward movements of pressure pistons having rod ends, an oil pressure pump for supplying a fluid to the first and second drive cylinders, a respective rod sensor for sensing the movement of the rods of each of the first and second drive cylinders, a control unit for receiving a sensing signal from each rod sensor and producing a control signal, an oil path change drive unit for supplying selectively the fluid from the oil pressure pump to the first and second drive cylinders according to a control signal from the control unit, the concrete transfer system of the concrete pump car comprising:

a first logic valve in which a first oil pressure line connected to one side of the oil pressure pump is connected to an input side of a main spool, the output side of the main spool being in communication with a rod side of the second drive cylinder by the medium of a third oil pressure line;

a second logic valve in which an input side of a main spool is connected to the first oil pressure line, thereby connecting the second logic valve in parallel to the first logic valve, the output side of the main spool being in communication with a piston side of the first drive cylinder by the medium of a fourth oil pressure line;

a third logic valve in which an input side of a main spool is connected to a second oil pressure line connected to the other side of the oil pressure pump, the output side of the main spool being in communication with a rod side of the first drive cylinder by the medium of a fifth oil pressure line;

a fourth logic valve in which an input side of a main spool is connected to the second oil pressure line, thereby connecting the fourth logic valve in parallel to the third logic valve, the output side of the main spool being in communication with a piston side of the second drive cylinder by the medium of a sixth oil pressure line;

a reverse currently preventive device having an input port installed on the first and second oil pressure lines for preventing a reverse current for generating to the oil pressure pump and output ports are connected with each other;

a high/low pressure selection valve having a supply port connected to an output port of the reverse current preventive device, a first work port combined with an oil pressure line, which is selectively communicated to the supply port and connected to control spool sides of the second and fourth logic valves, a second work port combined with an oil pressure line, which is selectively communicated to the supply port and connected to control spool sides of the first and third logic valves, and a discharge port selectively communicated to the first and second work ports;

a fifth logic valve in which a control spool side is connected to the first work port of the high/low pressure selection valve, a discharge side of the main spool is connected to the third oil pressure line and the input side of the main spool is connected to the fifth oil pressure line; and a sixth logic valve in which a control spool side is connected to the second work port of the high/low pressure selection valve, a discharge side of the main spool is connected to the fourth oil pressure line and the input side of the main spool is connected to the sixth oil pressure line.

2. The concrete transfer system of a concrete pump car of claim 1, wherein a check valve is installed on the oil pressure line between the high/low pressure selection valve and the reverse current preventive device for preventing a reverse current from generating toward the reverse current preventive device.

3. The concrete transfer system of a concrete pump car of claim 1, wherein the first to sixth logic valves, the reverse current preventive device and the high/low pressure selection valve are connected and arranged as one oil pressure unit.

4. The concrete transfer system of a concrete pump car of claim 1, wherein the high/low pressure selection valve is a 4/2 way valve which has two change positions changed by an operating force of an operation lever, and the two work ports, a supply port and the discharge port formed at the two change positions.

5. The concrete transfer system of a concrete pump car of claim 1, wherein the volume of the oil pressure pump is increased according to at least one of the transfer distance or the transfer capacity of the concrete and a plurality of the first to sixth pressure lines according to the oil pressure of the oil pressure pump are constructed.

6. The concrete transfer system of a concrete pump car of claim 2, wherein the volume of the oil pressure pump is increased according to at least one of the transfer distance or the transfer capacity of the concrete and a plurality of the first to sixth pressure lines according to the oil pressure of the oil pressure pump are constructed.

7. The concrete transfer system of a concrete pump car of claim 3, wherein the volume of the oil pressure pump is increased according to at least one of the transfer distance or the transfer capacity of the concrete and a plurality of the first to sixth pressure lines according to the oil pressure of the oil pressure pump are constructed.

8. The concrete transfer system of a concrete pump car of claim 4, wherein the volume of the oil pressure pump is increased according to at least one of the transfer distance or the transfer capacity of the concrete and a plurality of the first to sixth pressure lines according to the oil pressure of the oil pressure pump are constructed.

* * * * *